US011857034B2

(12) United States Patent
Itotsubo

(10) Patent No.: US 11,857,034 B2
(45) Date of Patent: Jan. 2, 2024

(54) TITANIUM SINTERED BODY, ORNAMENT, AND TIMEPIECE

(71) Applicant: Seiko Epson Corporation, Tokyo (JP)

(72) Inventor: Keisuke Itotsubo, Hachinohe (JP)

(73) Assignee: SEIKO EPSON CORPORATION

( * ) Notice: Subject to any disclaimer, the term of this patent is extended or adjusted under 35 U.S.C. 154(b) by 241 days.

(21) Appl. No.: 16/117,130

(22) Filed: Aug. 30, 2018

(65) Prior Publication Data

US 2019/0061003 A1 Feb. 28, 2019

(30) Foreign Application Priority Data

Aug. 31, 2017 (JP) ..... 2017-167825

(51) Int. Cl.

| | |
|---|---|
| ***A44C 27/00*** | (2006.01) |
| ***B22F 3/15*** | (2006.01) |
| ***B22F 3/24*** | (2006.01) |
| ***B22F 5/10*** | (2006.01) |
| ***C22C 1/04*** | (2023.01) |

(Continued)

(52) U.S. Cl.

CPC ..... *A44C 27/003* (2013.01); *B22F 1/06* (2022.01); *B22F 3/15* (2013.01); *B22F 3/24* (2013.01); *B22F 5/106* (2013.01); *C22C 1/0458* (2013.01); *C22C 14/00* (2013.01); *B22F 5/00* (2013.01); *B22F 2003/247* (2013.01);

(Continued)

(58) Field of Classification Search

CPC ..... C22C 1/0458; C22C 14/00; A44C 27/003

See application file for complete search history.

(56) References Cited

U.S. PATENT DOCUMENTS 5,409,518 A * 4/1995 Saito ..... C22C 1/0458 419/12
5,509,979 A * 4/1996 Kimura ..... C22C 14/00 148/421

(Continued)

FOREIGN PATENT DOCUMENTS

EP 2719781 A1 4/2014
JP 56025946 A * 3/1981 ..... G06K 15/02

(Continued)

OTHER PUBLICATIONS

Oh J., et al.; "Oxygen Effects on the Mechanical Properties and Lattice Strain of Ti and Ti-6AI-4V"; Met. Mater.; vol. 17, No. 5, 2011; pp. 733-736 (Year: 2011).*

(Continued)

*Primary Examiner* — Alexandra M Moore
*Assistant Examiner* — Austin Pollock
(74) *Attorney, Agent, or Firm* — Harness, Dickey & Pierce, P.L.C.

(57) ABSTRACT

A titanium sintered body has an average crystal grain diameter on the surface of more than 30 μm and 500 μm or less, and a Vickers hardness on the surface of 300 or more and 800 or less. In the titanium sintered body, it is preferred that crystal structures on the surface have an average aspect ratio of 1 or more and 3 or less. Further, in the titanium sintered body, it is preferred that the oxygen content on the surface is 2000 ppm by mass or more and 5500 ppm by mass or less. Further, in the titanium sintered body, it is preferred that titanium is contained as a main component, and an α-phase stabilizing element and a β-phase stabilizing element are also present.

4 Claims, 2 Drawing Sheets

(51) Int. Cl.
*B22F 1/06* (2022.01)
*C22C 14/00* (2006.01)
*B22F 5/00* (2006.01)

(52) U.S. Cl.
CPC ..... *B22F 2201/01* (2013.01); *B22F 2201/10* (2013.01); *B22F 2301/205* (2013.01)

(56) References Cited

U.S. PATENT DOCUMENTS

| | | | | |
|---|---|---|---|---|
| 5,759,484 | A * | 6/1998 | Kashii | C22C 14/00 148/421 |
| 5,885,375 | A * | 3/1999 | Takemura | C22F 1/183 148/421 |
| 6,221,173 | B1 * | 4/2001 | Shibuya | C23C 8/28 148/223 |
| 10,531,755 | B1 * | 1/2020 | Huang | F16B 2/12 |
| 10,851,437 | B2 * | 12/2020 | Yolton | B33Y 70/00 |
| 11,015,233 | B2 * | 5/2021 | Tsukamoto | C22F 1/183 |
| 11,118,246 | B2 * | 9/2021 | Tsukamoto | A44C 5/00 |
| 2001/0053460 | A1 * | 12/2001 | Sato | C23C 8/34 428/687 |
| 2003/0118858 | A1 * | 6/2003 | Kushida | C23C 8/34 428/627 |
| 2005/0072496 | A1 * | 4/2005 | Hwang | C22C 14/00 148/421 |
| 2005/0202271 | A1 * | 9/2005 | Yashiki | B32B 15/017 428/660 |
| 2005/0230007 | A1 * | 10/2005 | Horimura | C22F 1/183 148/281 |
| 2010/0173171 | A1 * | 7/2010 | Yashiki | C22F 1/183 428/586 |
| 2011/0277891 | A1 | 11/2011 | Clemens et al. | |
| 2013/0149183 | A1 * | 6/2013 | Araoka | B22F 1/004 419/13 |
| 2014/0044584 | A1 * | 2/2014 | Kanou | B22F 9/023 419/48 |
| 2014/0377119 | A1 * | 12/2014 | Abkowitz | B22F 3/12 419/23 |
| 2017/0067137 | A1 | 3/2017 | Kawasaki et al. | |
| 2017/0356076 | A1 * | 12/2017 | Mori | C23C 8/10 |
| 2019/0323114 | A1 * | 10/2019 | Sato | C22F 1/183 |
| 2020/0172996 | A1 * | 6/2020 | Tsukamoto | C22C 14/00 |
| 2020/0362438 | A1 * | 11/2020 | Tsukamoto | C22C 14/00 |

FOREIGN PATENT DOCUMENTS

| | | | | |
|---|---|---|---|---|
| JP | 05009630 | A | * | 1/1993 |
| JP | 05171321 | A | * | 7/1993 |
| JP | 07043478 | A | * | 2/1995 |
| JP | 07062466 | A | * | 3/1995 |
| JP | 07090432 | A | * | 4/1995 |
| JP | 07289566 | A | * | 11/1995 |
| JP | 08-092674 | A | | 4/1996 |
| JP | 08120373 | A | * | 5/1996 |
| JP | 11172362 | A | * | 6/1999 |
| JP | 2000-023718 | A | | 1/2000 |
| JP | 2000023718 | A | * | 1/2000 |
| JP | 2012-007223 | A | | 1/2012 |
| JP | 2012007223 | A | * | 1/2012 |
| JP | 2017-053021 | A | | 3/2017 |
| WO | WO-2012-148471 | A1 | | 11/2012 |

OTHER PUBLICATIONS

Extended European Search Report for Patent Application No. EP 18191692.5 dated Feb. 14, 2019 (8 pages).

E. Kimura et al., "Mechanical Properties of Sintered Ti-6A1-4V Alloy Using Metal Injection Molding Method", Japan Institute for Advanced Dentistry: Chief: Yanase Takeshi), dated Mar. 9, 2021, with English translation (18 pages).

K. Maekawa et al., "Effect of MIM Process Conditions on Microstructures and Mechanical Properties of Ti-6A1-4V Compacts", Graduate student, Nagoya University (present, Kurimoto, Ltd.), Mar. 31, 1999, with English translation, (15 pages).

* cited by examiner

TITANIUM SINTERED BODY, ORNAMENT, AND TIMEPIECE

BACKGROUND

1. Technical Field

The present invention relates to a titanium sintered body, an ornament, and a timepiece.

2. Related Art

Titanium alloys have a high mechanical strength and excellent corrosion resistance, and therefore have been used in aircraft, space development, chemical plants, and the like. Further, recently, by utilizing other characteristics such as biocompatibility, a low Young's modulus, and lightweightness, titanium alloys have begun to be applied to exterior components for watches, ornaments such as eyeglass frames, sporting goods such as golf clubs, springs, and the like.

Further, in the application of a titanium alloy in this manner, by using a powder metallurgy method, a titanium sintered body having a shape close to the final shape can be easily produced. Therefore, secondary processing can be omitted or reduced, and thus, components can be efficiently produced.

However, a titanium sintered body produced by a powder metallurgy method is likely to reflect the properties of a raw material powder, and therefore, it is difficult to obtain an appearance with a high design property. Therefore, an attempt to enhance the design property in the appearance of a titanium sintered body produced by a powder metallurgy method has been proposed.

For example, JP-A-8-92674 discloses a titanium alloy for ornaments obtained by powder compacting a mixed powder containing an iron powder in an amount of 0.1 to 1.0% by weight and a molybdenum powder in an amount of 0.1 to 4.0% by weight with the remainder being a titanium powder, followed by sintering at 1200 to 1350° C. The thus obtained titanium alloy contains an $\alpha+\beta$ two-phase structure and has a desired specularity for an exterior component for watches or the like.

However, the titanium alloy disclosed in JP-A-8-92674 contains iron in addition to titanium, and therefore has poor weather resistance. Due to this, in the case where the titanium alloy is exposed to a harsh environment over a long period of time, deterioration occurs on the surface, which may cause a decrease in specularity (design property).

SUMMARY

An advantage of some aspects of the invention is to provide a titanium sintered body, an ornament, and a timepiece having a high design property.

The advantage can be achieved by the following configuration.

A titanium sintered body according to an aspect of the invention has an average crystal grain diameter on the surface of more than 30 μm and 500 μm or less, and a Vickers hardness on the surface of 300 or more and 800 or less.

According to this configuration, the titanium sintered body has an excellent luster and a favorable polishing property, and therefore, the titanium sintered body having an appearance with a high design property is obtained.

In the titanium sintered body according to the aspect of the invention, it is preferred that crystal structures on the surface have an average aspect ratio of 1 or more and 3 or less.

According to this configuration, when the titanium sintered body is subjected to polishing processing, anisotropy is less likely to occur in the polishing amount, and therefore, irregularities are less likely to occur on the polished surface. As a result, the smoothness of the polished surface can be further enhanced, and the titanium sintered body having a high luster and a high design property is obtained.

In the titanium sintered body according to the aspect of the invention, it is preferred that the oxygen content on the surface is 2000 ppm by mass or more and 5500 ppm by mass or less.

According to this configuration, the titanium sintered body has excellent wear resistance. Therefore, for example, the luster on the surface of the titanium sintered body can be favorably maintained over a long period of time. As a result, a high design property in the appearance of the titanium sintered body can be maintained over a long period of time.

In the titanium sintered body according to the aspect of the invention, it is preferred that titanium is contained as a main component, and an $\alpha$-phase stabilizing element and a $\beta$-phase stabilizing element are contained.

According to this configuration, even if the production conditions or use conditions for the titanium sintered body change, the titanium sintered body can have both an $\alpha$-phase and a $\beta$-phase as the crystal structures. Therefore, the titanium sintered body has both the characteristics exhibited by the $\alpha$-phase and the characteristics exhibited by the $\beta$-phase, and thus has particularly excellent mechanical properties.

An ornament according to an aspect of the invention includes the titanium sintered body according the aspect of the invention.

According to this configuration, an excellent design property based on a luster can be imparted to the surface of the ornament. As a result, an ornament having an appearance with a high appealing property is obtained.

A timepiece according to an aspect of the invention includes the titanium sintered body according the aspect of the invention.

According to this configuration, an excellent design property based on a luster can be imparted to the surface of the timepiece. As a result, a timepiece having an appearance with a high appealing property is obtained.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, a titanium sintered body, an ornament, and a timepiece according to the invention will be described in detail with reference to preferred embodiments shown in the accompanying drawings.

Titanium Sintered Body

First, an embodiment of the titanium sintered body according to the invention will be described.

The titanium sintered body according to this embodiment is, for example, a sintered body produced by a powder metallurgy method. This titanium sintered body is formed by sintering particles of a titanium alloy powder to one another.

The titanium sintered body according to this embodiment has an average crystal grain diameter on the surface of more than 30 μm and 500 μm or less, and a Vickers hardness on the surface of 300 or more and 800 or less.

As a result of intensive studies, the present inventors found that the design property in the appearance of the titanium sintered body becomes very high when the average crystal grain diameter is within the above range. That is, in the case where the average crystal grain diameter is within the above range, an area occupied by one crystal is larger as compared with the related art. Therefore, for example, when one crystal reflects light, since most crystals have a smooth surface, almost all of the light is regularly reflected by a relatively large smooth surface. Moreover, such crystals are distributed all over the sintered body, and also the normal directions of the respective crystal planes are slightly different from one another. Therefore, an excellent luster is imparted to the entire titanium sintered body. As a result, the titanium sintered body having an appearance with a high design property is obtained.

Further, such a titanium sintered body has a sufficient surface hardness, and therefore is hardly scratched even if a foreign substance or the like hits the sintered body. Due to this, the appearance with a high design property can be stably maintained over a long period of time. Therefore, such a titanium sintered body can be favorably used in the below-mentioned ornaments, timepieces, and the like. On the other hand, such a titanium sintered body also has a favorable polishing property, and therefore, a smooth polished surface can be efficiently obtained. As a result, a titanium sintered body having an appearance with a high design property can be efficiently obtained by polishing.

Figure 1:
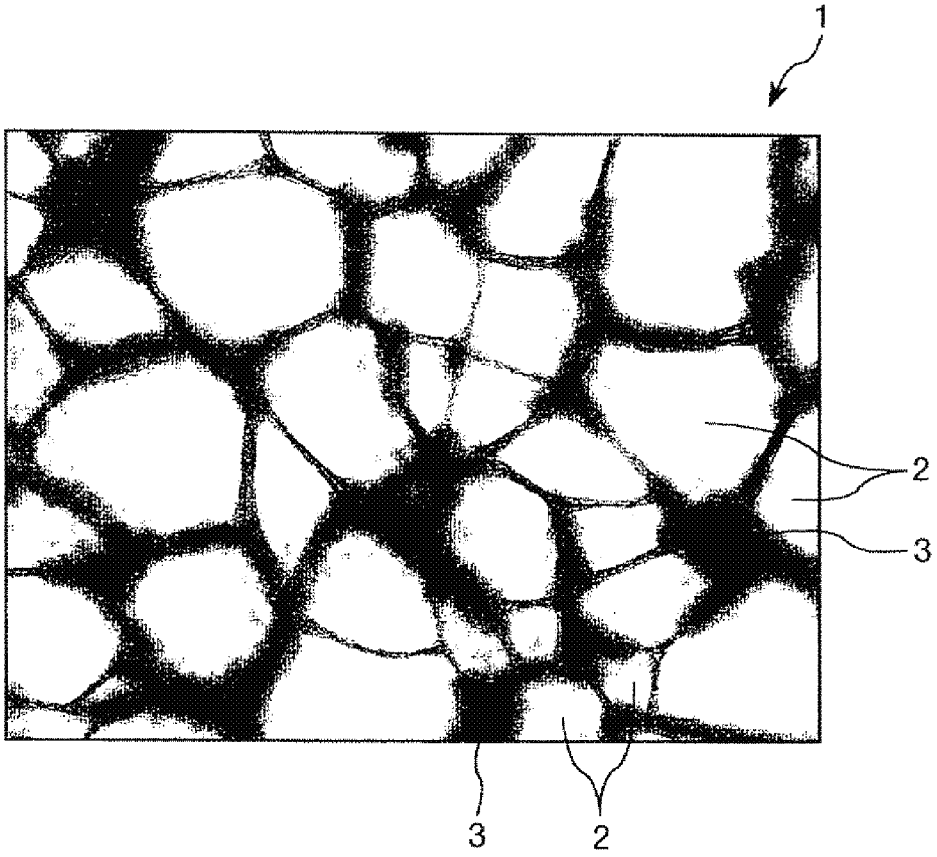
FIG. 1 is a view schematically showing the surface of an embodiment of a titanium sintered body according to the invention.

FIG. 1 is a view schematically showing the surface of an embodiment of the titanium sintered body according to the invention.

In general, the crystal structure of a titanium sintered body varies depending on the alloy composition, however, as in the case of a titanium sintered body 1 shown in FIG. 1, it is preferred to include an α-phase 2 and a β-phase 3. Among these, the α-phase 2 refers to a region (α-phase titanium) in which the crystal structure forming the phase is mainly a hexagonal closest packed (hcp) structure. On the other hand, the β-phase 3 refers to a region (β-phase titanium) in which the crystal structure forming the phase is mainly a body-centered cubic (bcc) structure. In FIG. 1, a region with a relatively light color is the α-phase 2, and a region with a relatively dark color is the β-phase 3.

The α-phase 2 has a relatively low hardness and high ductility, and therefore contributes to the realization of the titanium sintered body 1 having a high strength and excellent deformation resistance particularly at a high temperature. On the other hand, the β-phase 3 has a relatively high hardness, but is likely to be plastically deformed, and therefore contributes to the realization of the titanium sintered body 1 having excellent toughness as a whole. By including the α-phase 2 and the β-phase 3, when the titanium sintered body 1 is polished, the resistance during polishing can be prevented from significantly increasing. As a result, the smoothness of the polished surface can be further enhanced, and an appearance with a higher design property is obtained.

It is preferred that almost the entire surface of the titanium sintered body 1 is occupied by such an α-phase 2 and a β-phase 3. That is, the total occupancy ratio (area ratio) of the α-phase 2 and the β-phase 3 on the surface of the titanium sintered body 1 is preferably 95% or more, and more preferably 98% or more. In such a titanium sintered body 1, the α-phase 2 and the β-phase 3 become dominant in terms of characteristics, and therefore, the titanium sintered body 1 reflects many advantages of titanium.

The total occupancy ratio of the α-phase 2 and the β-phase 3 is obtained by, for example, observing the cross section of the titanium sintered body 1 with an electron microscope, a light microscope, or the like and distinguishing the crystal phases based on the difference in color or the contrast due to the difference in crystal structure and also measuring the areas.

Examples of crystal structures other than the α-phase 2 and the β-phase 3 include an w-phase and a γ-phase. In the case where the titanium sintered body 1 includes the α-phase 2 and the β-phase 3 as described above, the occupancy ratio (area ratio) of the α-phase 2 on the surface is preferably 70% or more and 99.8% or less, and more preferably 75% or more and 99% or less. When the α-phase 2 is dominant in this manner, the above-mentioned luster becomes more prominent, and thus, a titanium sintered body having an appearance with a particularly high design property is obtained. This is because the α-phase 2 is a plate-like crystal phase, and therefore, the crystal plane is likely to be a smooth surface, and thus, the crystal grain diameter as described above is likely to be satisfied, and also regular reflection of light is likely to occur thereon.

The occupancy ratio of the α-phase 2 is measured as follows. First, the surface of the titanium sintered body 1 is observed with an electron microscope, and the area of the obtained observation image is calculated. Subsequently, the total area of the α-phase 2 in the observation image is obtained. Then, the obtained total area of the α-phase 2 is divided by the area of the observation image. The resulting value is the occupancy ratio of the α-phase 2.

On the other hand, in the case where the area ratio of the α-phase 2 is as described above, the area ratio of the β-phase 3 is smaller than that. Specifically, the area ratio of the β-phase 3 is preferably about 0.2% or more and 30% or less, more preferably about 1% or more and 25% or less, and further more preferably about 2% or more and 20% or less. When the β-phase 3 is included at a given ratio in this manner, the desired balance between the α-phase 2 and the β-phase 3 is achieved. As a result, even if the crystal grain diameter of the α-phase 2 becomes relatively large, a decrease in the mechanical properties or the surface hardness of the titanium sintered body 1 as a whole is suppressed. Therefore, the titanium sintered body 1 capable of stably maintaining the above-mentioned average crystal grain diameter and Vickers hardness is obtained.

By balancing the α-phase 2 and the β-phase 3, when the titanium sintered body 1 is polished, the resistance during polishing can be particularly favorably prevented from significantly increasing. As a result, the smoothness of the polished surface can be particularly enhanced, and an appearance with a particularly high design property is obtained.

Further, since the α-phase 2 is dominant, the occurrence of irregularities on the polished surface due to the difference in the polishing speed based on the difference in the hardness between the α-phase 2 and the β-phase 3 is easily suppressed. Also from such a viewpoint, an appearance with a high design property is obtained.

When the average crystal grain diameter is less than the above lower limit, an area where light is regularly reflected is too small, and therefore, the light beam becomes too thin and the luster may be lost. On the other hand, when the average crystal grain diameter exceeds the above upper limit, an area where light is regularly reflected is too large, and therefore, the number of light beams is decreased, and the luster generated by a large number of light beams may be lost. Further, the shape of the crystal structure (particularly, the α-phase 2) is likely to approach a needle shape from a spherical shape. The crystal structures having such a needle shape are likely to be aligned along a specific direction due to the nature of the shape. As a result, the arrangement of the crystal planes from which light is reflected also becomes irregular, and therefore, the luster may be deteriorated.

The average crystal grain diameter on the surface of the titanium sintered body is preferably 35 μm or more and 400 μm or less, and more preferably 40 μm or more and 300 μm or less.

Such an average crystal grain diameter is measured as follows. First, the surface of the titanium sintered body 1 is observed with an electron microscope, and 100 or more crystal structures in the obtained observation image are randomly selected. Subsequently, the area of each crystal structure selected in the observation image is calculated, and the diameter of a circle having the same area as that of this area is obtained. The diameter of the circle obtained in this manner is regarded as the grain diameter (circle equivalent diameter) of the crystal structure, and an average for 100 or more crystal structures is obtained. This average becomes the average grain diameter of the crystal structures.

Further, when the Vickers hardness is less than the above lower limit, the surface of the titanium sintered body may be easily scratched when a foreign substance or the like hits the surface. On the other hand, when the Vickers hardness exceeds the above upper limit, the surface of the titanium sintered body is hardly polished, and therefore, it becomes difficult to obtain a desired polished surface. As a result, an appearance with a high design property may be less likely to be obtained.

The Vickers hardness (HV) on the surface of the titanium sintered body 1 is preferably 400 or more and 750 or less, and more preferably 500 or more and 700 or less.

Such a Vickers hardness is measured in accordance with a Vickers hardness test—Test method specified in JIS Z 2244:2009. A test force applied by an indenter is set to 9.8 N (1 kgf), and the duration of the test force is set to 15 seconds. Then, an average of the measurement results at 10 sites is determined to be the Vickers hardness.

The shape of the crystal structure of the titanium sintered body according to this embodiment is not a needle shape, but is preferably an isotropic shape or a shape equivalent thereto. When the crystal structure of the titanium sintered body has such a shape, an appearance having a high luster and a high design property can be obtained as described above.

Specifically, on the surface of the titanium sintered body 1, the average aspect ratio of the crystal structures is preferably 1 or more and 3 or less, and more preferably 1 or more and 2.5 or less. When the average aspect ratio of the crystal structures is within the above range, the luster on the surface of the titanium sintered body 1 can be particularly enhanced. Further, by adjusting the average aspect ratio within the above range, when the titanium sintered body 1 is subjected to polishing processing, anisotropy is less likely to occur in the polishing amount, and therefore, irregularities are less likely to occur on the polished surface. As a result, the smoothness of the polished surface can be further enhanced, and the titanium sintered body 1 having a high luster is obtained also from this viewpoint.

The average aspect ratio of the crystal structures is measured as follows. First, the surface of the titanium sintered body 1 is observed with an electron microscope, and 100 or more crystal structures in the obtained observation image are randomly selected. Subsequently, the major axis of each crystal structure selected in the observation image is specified, and further, the longest axis in the direction orthogonal to this major axis is specified as the minor axis. Then, the ratio of the major axis to the minor axis is calculated as the aspect ratio. Then, the aspect ratios of 100 or more crystal structures is averaged, and the resulting value is determined to be the average aspect ratio.

In the titanium sintered body 1 according to this embodiment, it is preferred that the grain diameters of the crystal structures are relatively uniform. According to this, because the crystal structures not only have an isotropic shape or a shape equivalent thereto, but also have a uniform grain diameter, the fatigue strength of the titanium sintered body 1 is increased, and also a high design property can be maintained for a long period of time.

The constituent material of such a titanium sintered body 1 is a titanium simple substance or a titanium-based alloy.

The titanium-based alloy is an alloy containing titanium as a main component, but is an alloy containing, other than titanium (Ti), for example, an element such as carbon (C), nitrogen (N), oxygen (O), aluminum (Al), vanadium (V), niobium (Nb), zirconium (Zr), tantalum (Ta), molybdenum (Mo), chromium (Cr), manganese (Mn), cobalt (Co), iron (Fe), silicon (Si), gallium (Ga), tin (Sn), barium (Ba), nickel (Ni), or sulfur (S).

Among these, the titanium-based alloy according to this embodiment preferably contains titanium as a main component, and also contains an α-phase stabilizing element and a β-phase stabilizing element. According to this, even if the production conditions or use conditions for the titanium sintered body change, the titanium sintered body can have both the α-phase 2 and the β-phase 3 as the crystal structures. Due to this, the titanium sintered body 1 has both the characteristics exhibited by the α-phase 2 and the characteristics exhibited by the β-phase 3, and thus has particularly excellent mechanical properties.

Examples of the α-phase stabilizing element include aluminum, gallium, tin, carbon, nitrogen, and oxygen, and these are used alone or two or more types thereof are used in combination. On the other hand, examples of the β-phase stabilizing element include molybdenum, niobium, tantalum, vanadium, and iron, and these are used alone or two or more types thereof are used in combination.

As a specific composition of the titanium-based alloy, titanium alloys specified in JIS H 4600:2012 as type 60, type 60E, type 61, and type 61F are exemplified. Specific examples thereof include Ti-6Al-4V, Ti-6Al-4V ELI, and Ti-3Al-2.5V. Other examples thereof include Ti-6Al-6V-2Sn, Ti-6Al-2Sn-4Zr-2Mo-0.08Si, and Ti-6Al-2Sn-4Zr-6Mo specified in Aerospace Material Specifications (AMS). Further, additional examples thereof include Ti-5Al-2.5Fe and Ti-6Al-7Nb specified in the specification made by International Organization for Standardization (ISO), and also include Ti-13Zr-13Ta, Ti-6Al-2Nb-1Ta, Ti-15Zr-4Nb-4Ta, and Ti-5Al-3Mo-4Zr.

In the notation of the above-mentioned alloy composition, the components are shown in decreasing order of concentration from left to right, and the number shown before the element indicates the concentration of the element in mass %. For example, Ti-6Al-4V shows that the alloy contains Al at 6 mass % and V at 4 mass % with the remainder being Ti and impurities. The impurities are elements which are inevitably mixed therein or elements which are intentionally added thereto at predetermined ratios (for example, the total amount of impurities is 0.40 mass % or less).

Further, the ranges for main alloy compositions described above are as follows.

The Ti-6Al-4V alloy contains Al at 5.5 mass % or more and 6.75 mass % or less and V at 3.5 mass % or more and 4.5 mass % or less with the remainder being Ti and impurities. As the impurities, for example, Fe at 0.4 mass % or less, O at 0.2 mass % or less, N at 0.05 mass % or less, H at 0.015 mass % or less, and C at 0.08 mass % or less are permitted to be contained, respectively. Further, other elements are permitted to be contained at 0.10 mass % or less individually and 0.40 mass % or less in total, respectively.

The Ti-6Al-4V ELI alloy contains Al at 5.5 mass % or more and 6.5 mass % or less and V at 3.5 mass % or more and 4.5 mass % or less with the remainder being Ti and impurities. As the impurities, for example, Fe at 0.25 mass % or less, O at 0.13 mass % or less, N at 0.03 mass % or less, H at 0.0125 mass % or less, and C at 0.08 mass % or less are permitted to be contained, respectively. Further, other elements are permitted to be contained at 0.10 mass % or less individually and 0.40 mass % or less in total, respectively.

The Ti-3Al-2.5V alloy contains Al at 2.5 mass % or more and 3.5 mass % or less, V at 1.6 mass % or more and 3.4 mass % or less, S (if desired) at 0.05 mass % or more and 0.20 mass % or less, and at least one element (if desired) selected from La, Ce, Pr, and Nd at 0.05 mass % or more and 0.70 mass % or less in total with the remainder being Ti and impurities. As the impurities, for example, Fe at 0.30 mass % or less, O at 0.25 mass % or less, N at 0.05 mass % or less, H at 0.015 mass % or less, and C at 0.10 mass % or less are permitted to be contained, respectively. Further, other elements are permitted to be contained at 0.40 mass % or less in total.

The Ti-5Al-2.5Fe alloy contains Al at 4.5 mass % or more and 5.5 mass % or less and Fe at 2 mass % or more and 3 mass % or less with the remainder being Ti and impurities. As the impurities, for example, O at 0.2 mass % or less, N at 0.05 mass % or less, H at 0.013 mass % or less, and C at 0.08 mass % or less are permitted to be contained, respectively. Further, other elements are permitted to be contained at 0.40 mass % or less in total.

The Ti-6Al-7Nb alloy contains Al at 5.5 mass % or more and 6.5 mass % or less and Nb at 6.5 mass % or more and 7.5 mass % or less with the remainder being Ti and impurities. As the impurities, for example, Ta at 0.50 mass % or less, Fe at 0.25 mass % or less, O at 0.20 mass % or less, N at 0.05 mass % or less, H at 0.009 mass % or less, and C at 0.08 mass % or less are permitted to be contained, respectively. Further, other elements are permitted to be contained at 0.40 mass % or less in total. The Ti-6Al-7Nb alloy has particularly low cytotoxicity as compared with other alloy types, and therefore is particularly useful when the titanium sintered body 1 is used for biocompatible purposes.

The components contained in the titanium sintered body 1 can be analyzed by, for example, a method in accordance with Titanium-ICP atomic emission spectrometry specified in JIS H 1632-1:2014 to JIS H 1632-3:2014.

The titanium sintered body 1 may also include particles containing titanium oxide as a main component (hereinafter simply referred to as "titanium oxide particles"). It is considered that the titanium oxide particles share the stress applied to metal titanium serving as the matrix by being dispersed in the titanium sintered body 1. By including the titanium oxide particles, the mechanical strength of the entire titanium sintered body 1 is improved. Further, since titanium oxide is harder than metal titanium, by dispersing the titanium oxide particles, the wear resistance of the titanium sintered body 1 can be further increased. Due to this, scratching or the like of the polished surface is suppressed, and therefore, the polished surface can be kept favorable for a long period of time. That is, a high design property in the appearance of the titanium sintered body 1 can be maintained over a long period of time. Further, titanium oxide is chemically stable, and therefore is useful also from the viewpoint of enhancing the corrosion resistance of the titanium sintered body 1.

The "particle containing titanium oxide as a main component" refer to, for example, a particle analyzed such that an element contained in the largest amount in terms of atomic ratio is either one of titanium and oxygen, and an element contained in the second largest is the other when a component analysis of the particle of interest is performed by X-ray fluorescence spectroscopy or using an electron probe microanalyzer.

The average particle diameter of the titanium oxide particles is not particularly limited, but is preferably 0.5 μm or more and 20 μm or less, more preferably 1 μm or more and 15 μm or less, and further more preferably 2 μm or more and 10 μm or less. When the average particle diameter of the titanium oxide particles is within the above range, the wear resistance can be increased without largely deteriorating the mechanical properties such as toughness and tensile strength of the titanium sintered body 1. That is, when the average particle diameter of the titanium oxide particles is less than the above lower limit, the effect of sharing the stress of the titanium oxide particles may be decreased depending on the content of the titanium oxide particles. Further, when the average particle diameter of the titanium oxide particles exceeds the above upper limit, the titanium oxide particle may serve as a starting point of a crack to decrease the mechanical strength depending on the content of the titanium oxide particles.

The crystal structure of the titanium oxide particle may be any of a rutile type, an anatase type, and a brookite type, and may be a mixture of a plurality of types.

The average particle diameter of the titanium oxide particles is measured as follows. First, the cross section of the titanium sintered body 1 is observed with an electron microscope, and 100 or more titanium oxide particles in the obtained observation image are randomly selected. At this time, whether a particle is the titanium oxide particle or not can be specified by the contrast of the image and an area analysis of oxygen or the like. Subsequently, the area of each titanium oxide particle selected in the observation image is calculated, and the diameter of a circle having the same area as that of this area is obtained. The diameter of the circle obtained in this manner is regarded as the particle diameter (circle equivalent diameter) of the titanium oxide particle, and an average for 100 or more titanium oxide particles is obtained. This average is determined as the average particle diameter of the titanium oxide particles.

The titanium sintered body 1 according to this embodiment has an oxygen content (concentration expressed in terms of element) on the surface is preferably 2000 ppm by mass or more and 5500 ppm by mass or less, more preferably 2200 ppm by mass or more and 5000 ppm by mass or less, and further more preferably 2500 ppm by mass or more and 4500 ppm by mass or less. Such a titanium sintered body 1 has excellent wear resistance. Therefore, for example, the luster on the surface of the titanium sintered body 1 can be kept favorable for a long period of time. As a result, a high design property in the appearance of the titanium sintered body 1 can be maintained over a long period of time.

When the oxygen content is less than the above lower limit, titanium oxide in the titanium sintered body 1 is decreased. Titanium oxide has a function to increase the corrosion resistance of the titanium sintered body and make the titanium sintered body less likely to wear out as described above. Due to this, when the oxygen content is less than the above lower limit, titanium oxide is particularly decreased, and accompanying this, the corrosion resistance may be decreased, and also wear resistance may be decreased. On the other hand, when the oxygen content exceeds the above upper limit, titanium oxide in the titanium sintered body 1 is increased. Due to this, the proportion of a metal bond between metal titanium atoms is decreased, and the mechanical strength may be decreased. Due to this, for example, peeling, cracking, or the like is likely to occur on a sliding surface, and accompanying this, the frictional resistance is increased, and therefore, the wear resistance may be decreased.

The titanium sintered body 1 according to this embodiment has a carbon content on the surface is preferably 200 ppm by mass or more and 4000 ppm by mass or less, more preferably 400 ppm by mass or more and 3000 ppm by mass or less, and further more preferably 500 ppm by mass or more and 2000 ppm by mass or less. In such a titanium sintered body 1, the desired concentration of titanium carbide on the surface is achieved, and therefore, light scattering or the like by titanium carbide is suppressed, and the progress of oxidation of metal titanium can be suppressed. Therefore, the titanium sintered body 1 can keep the luster on the surface favorable over a long period of time.

The oxygen content and the carbon content in the titanium sintered body 1 can be measured by, for example, an atomic absorption spectrometer, an ICP optical emission spectrometer, an oxygen-nitrogen simultaneous analyzer, or the like. In particular, a method for determination of oxygen content in metallic materials specified in JIS Z 2613:2006 is also used. For example, an oxygen-nitrogen analyzer, TC-300/EF-300 manufactured by LECO Corporation is used.

Further, an X-ray diffraction pattern obtained by subjecting the titanium sintered body 1 to a crystal structure analysis by X-ray diffractometry includes a diffraction intensity peak derived from the α-phase and a diffraction intensity peak derived from the β-phase.

Here, it is preferred that the obtained X-ray diffraction pattern particularly includes a diffraction intensity peak attributed to the plane orientation (100) of the α-phase titanium and a diffraction intensity peak attributed to the plane orientation (110) of the β-phase titanium. In addition, the value of the diffraction intensity peak (integrated intensity) attributed to the plane orientation (110) of the β-phase titanium is preferably 3% or more and 60% or less, more preferably 5% or more and 50% or less, and further more preferably 10% or more and 40% or less of the value of the diffraction intensity peak (integrated intensity) attributed to the plane orientation (100) of the α-phase titanium. According to this, both the characteristics of the α-phase 2 and the characteristics of the β-phase 3 described above become obvious without being buried. As a result, the titanium sintered body 1 having excellent toughness as a whole and also having an appearance with a higher design property is obtained.

The diffraction intensity peak attributed to the plane orientation (100) of the α-phase titanium is located at 2θ of about 35.3°. On the other hand, the diffraction intensity peak attributed to the plane orientation (110) of the β-phase titanium is located at 2θ of about 39.5°.

Further, it is preferred that an X-ray diffraction pattern obtained by subjecting the titanium sintered body 1 containing vanadium as a constituent element to a crystal structure analysis by X-ray diffractometry includes a diffraction intensity peak A attributed to the hexagonal crystal structure (space group: P6/mmc) of titanium and a diffraction intensity peak B attributed to the tetragonal crystal structure (space group: P42/mnm) of vanadium oxide represented by $V_4O_9$. In addition, the integrated intensity of the peak A located at θ of 40.3±0.2° is preferably 5 times or more, more preferably 7 times or more and 50 times or less, and further more preferably 9 times or more and 30 times or less the integrated intensity of the peak B located at 2θ of 21.3±0.2°. When the peak A and the peak B have such a relationship, a particularly favorable luster is obtained on the surface of the titanium sintered body 1. As a result, the titanium sintered body 1 having a particularly favorable design property is obtained.

As the X-ray source of the X-ray diffractometer, Cu-Kα radiation is used, and the tube voltage is set to 30 kV, and the tube current is set to 20 mA.

Further, the titanium sintered body 1 has a relative density of preferably 99% or more, and more preferably 99.5% or more. When the relative density of the titanium sintered body 1 is within the above range, the titanium sintered body 1 having particularly good specularity when polishing the surface is obtained. That is, when the titanium sintered body 1 has such a relative density, pores are hardly formed in the titanium sintered body 1. Due to this, the inhibition of light reflection by such pores can be suppressed.

The relative density of the titanium sintered body 1 is a dry density measured in accordance with the test method of density of sintered metal materials specified in JIS Z 2501:2000.

Further, the arithmetic average roughness Ra on the surface of the titanium sintered body 1 is preferably 7 μm or less, more preferably 5 μm or less, and further more preferably 4 μm or less. When the arithmetic average roughness Ra is within the above range, the design property based on the luster of the titanium sintered body 1 becomes particularly favorable. In particular, the arithmetic average roughness Ra represents an average in the height direction of irregularities, and therefore is considered to have an influence on the proportion of regular reflection of light, and thereby has an influence on the luster.

Further, the root mean square roughness Rq on the surface of the titanium sintered body 1 is preferably 10 μm or less, more preferably 8 μm or less, and further more preferably 7 μm or less. When the root mean square roughness Rq is within the above range, the design property based on the luster of the titanium sintered body 1 becomes particularly favorable. In particular, the root mean square roughness Rq corresponds to the standard deviation of a distance from an average surface, and therefore, it is considered that when this value is within the above range, a variation in the angle of the light reflection surface is suppressed, resulting in obtaining a favorable luster.

The surface roughness can be measured using a white light confocal microscope.

Such a titanium sintered body 1 can be applied to various uses and is particularly useful as a constituent material of an ornament, although the use thereof is not particularly limited.

Ornament

Next, an embodiment of an ornament according to the invention will be described.

Examples of the ornament according to the invention include exterior components for watches such as watch cases (case bodies, case backs, one-piece cases in which a case body and a case back are integrated, etc.), watch bands (including band clasps, band-bangle attachment mechanisms, etc.), bezels (for example, rotatable bezels, etc.), crowns (for example, screw-lock crowns, etc.), buttons, glass frames, dial rings, etching plates, and packings, personal ornaments such as glasses (for example, glasses frames), tie clips, cuff buttons, rings, necklaces, bracelets, anklets, brooches, pendants, earrings, and pierced earrings, tableware such as spoons, forks, chopsticks, knives, butter knives, and corkscrews, lighters or lighter cases, sports goods such as golf clubs, nameplates, panels, prize cups, and other exterior components for apparatuses such as housings (for example, housings for cellular phones, smartphones, tablet terminals, mobile computers, music players, cameras, shavers, etc.). For any of these ornaments, excellent aesthetic appearance is sometimes regarded very highly.

These ornaments include the titanium sintered body 1. According to this, an excellent design property based on a luster can be imparted to the surface of the ornament. As a result, an ornament having an appearance with a high appealing property is obtained.

Figure 2:
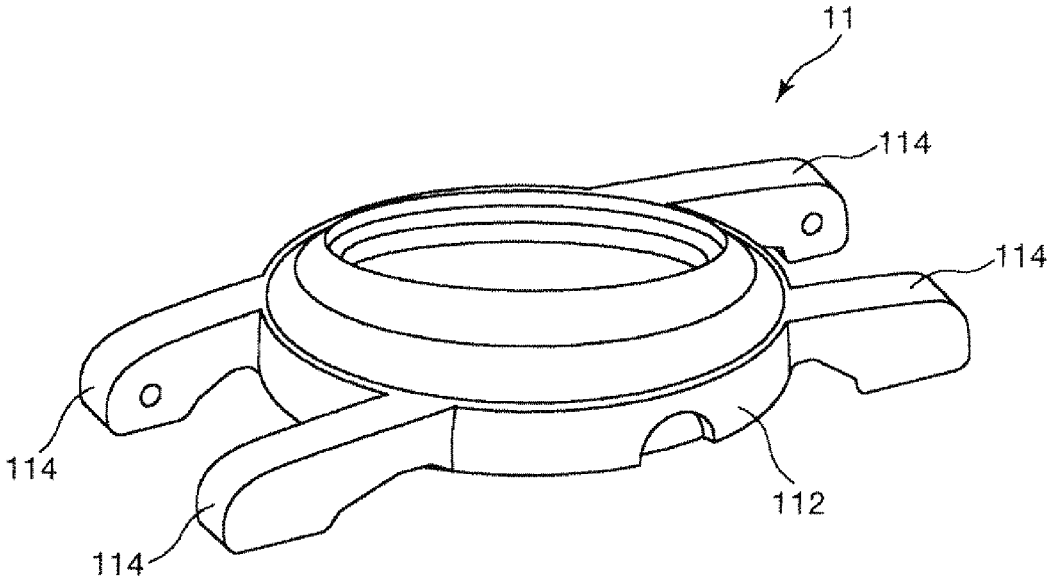
FIG. 2 is a perspective view showing a watch case to which an embodiment of an ornament according to the invention is applied.
Figure 3:
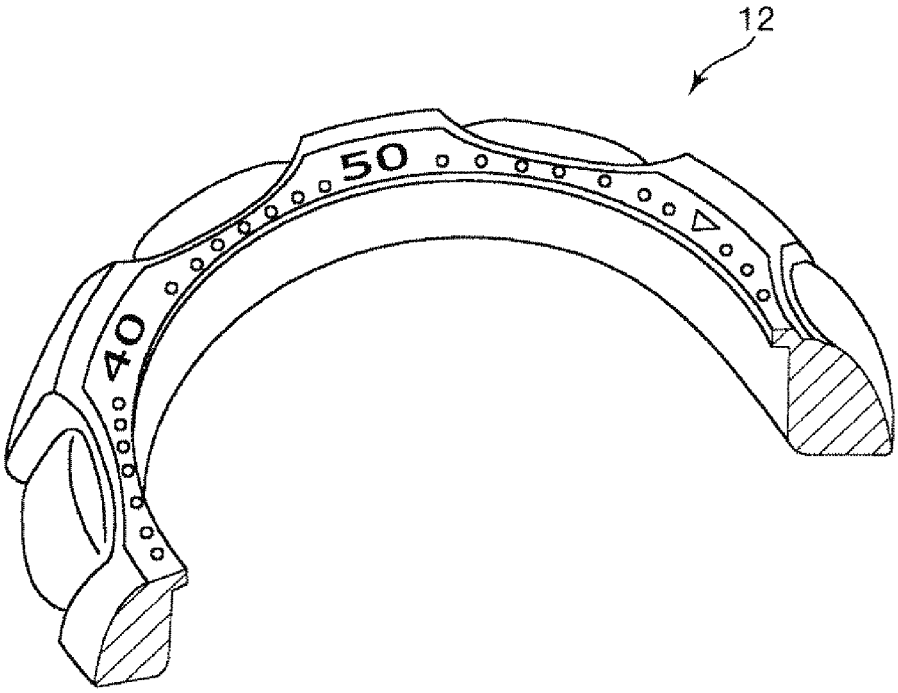
FIG. 3 is a partial cross-sectional perspective view showing a bezel to which an embodiment of an ornament according to the invention is applied.

FIG. 2 is a perspective view showing a watch case to which the embodiment of the ornament according to the invention is applied. FIG. 3 is a partial cross-sectional perspective view showing a bezel to which the embodiment of the ornament according to the invention is applied.

A watch case 11 shown in FIG. 2 includes a case body 112 and a band attachment section 114 for attaching a watch band provided protruding from the case body 112. Such a watch case 11 can form a container along with a glass plate (not shown) and a case back (not shown). In this container, a movement (not shown), a dial plate (not shown), etc. are housed. Therefore, this container protects the movement and the like from the external environment and also has a great influence on the aesthetic appearance of the watch.

A bezel 12 shown in FIG. 3 has an annular shape, and is attached to a watch case, and is rotatable with respect to the watch case. When the bezel 12 is attached to the watch case, the bezel 12 is located outside the watch case, and therefore has an influence on the aesthetic appearance of the watch.

Further, such a watch case 11 and a bezel 12 are used in a state where they are attached to the human body, and therefore could be scratched. Due to this, by using the titanium sintered body 1 as a constituent material of such an ornament, an ornament having high specularity on the surface and also having excellent aesthetic appearance is obtained. In addition, this specularity can be maintained for a long period of time.

The timepiece according to this embodiment includes the titanium sintered body 1 as various components for timepieces as described above. According to this, an excellent design property based on a luster can be imparted to the surface of the timepiece. As a result, a timepiece having an appearance with a high appealing property is obtained.

Method for Producing Titanium Sintered Body

Next, a method for producing the titanium sintered body 1 will be described.

The method for producing the titanium sintered body 1 includes [1] a step of obtaining a kneaded material by kneading a titanium alloy powder and an organic binder, [2] a step of obtaining a molded body by molding the kneaded material by a powder metallurgy method, [3] a step of obtaining a degreased body by degreasing the molded body, [4] a step of obtaining a sintered body by firing the degreased body, and [5] a step of performing a hot isostatic pressing treatment (HIP treatment) for the sintered body. Hereinafter, the respective steps will be sequentially described.

[1] Kneading Step

First, a titanium simple substance powder or a titanium alloy powder (hereinafter simply referred to as "titanium alloy powder") to serve as a raw material of the titanium sintered body 1 is kneaded along with an organic binder, whereby a kneaded material is obtained.

The average particle diameter of the titanium alloy powder is not particularly limited, but is preferably 1 μm or more and 50 μm or less, and more preferably 5 μm or more and 40 μm or less.

The titanium alloy powder may be a powder (a pre-alloy powder) composed only of particles having a single alloy composition or may be a mixed powder (a pre-mix powder) obtained by mixing a plurality of types of particles having different compositions from one another. In the case of a pre-mix powder, an individual particle may be a particle containing only one type of element or a particle containing a plurality of elements as long as a compositional ratio as described above is satisfied as a whole pre-mix powder.

The content of the organic binder in the kneaded material is appropriately set according to the molding conditions, the shape to be molded, or the like, but is preferably about 2 mass % or more and 20 mass % or less, and more preferably about 5 mass % or more and 10 mass % or less of the total amount of the kneaded material. By setting the content of the organic binder within the above range, the kneaded material has favorable fluidity. According to this, the filling property of the kneaded material when performing molding is improved, and a sintered body having a shape closer to a desired shape (near-net shape) is obtained in the end.

Examples of the organic binder include polyolefins such as polyethylene, polypropylene, and ethylene-vinyl acetate copolymers, acrylic resins such as polymethyl methacrylate and polybutyl methacrylate, styrenic resins such as polystyrene, polyesters such as polyvinyl chloride, polyvinylidene chloride, polyamide, polyethylene terephthalate, and polybutylene terephthalate, various resins such as polyether, polyvinyl alcohol, polyvinylpyrrolidone, and copolymers thereof, and various organic binders such as various waxes, paraffins, higher fatty acids (such as stearic acid), higher alcohols, higher fatty acid esters, and higher fatty acid amides. These can be used alone or two or more types thereof can be mixed and used.

In the kneaded material, a plasticizer may be added if desired. Examples of the plasticizer include phthalate esters (such as DOP, DEP, and DBP), adipate esters, trimellitate esters, and sebacate esters. These can be used alone or two or more types thereof can be mixed and used.

Further, in the kneaded material, other than the titanium alloy powder, the organic binder, and the plasticizer, for example, any of a variety of additives such as a lubricant, an antioxidant, a degreasing accelerator, and a surfactant can be added.

The kneading conditions vary depending on the respective conditions such as the alloy composition or the particle diameter of the titanium alloy powder to be used, the composition of the organic binder, and the blending amounts thereof. However, for example, the kneading temperature can be about 50° C. or higher and 200° C. or lower, and the kneading time can be about 15 minutes or more and 210 minutes or less.

Further, the kneaded material is formed into a pellet (small particle). The particle diameter of the pellet is, for example, about 1 mm or more and 15 mm or less.

Incidentally, depending on the molding method described below, a granulated powder may be produced instead of the kneaded material.

[2] Molding Step

Subsequently, the kneaded material is molded, whereby a molded body is produced.

The molding method is not particularly limited, and for example, any of a variety of molding methods such as a powder compacting (compression molding) method, a metal injection molding (MIM) method, and an extrusion molding method can be used. Among these, from the viewpoint that a sintered body having a near-net shape can be produced, a metal injection molding method is preferably used.

The molding conditions in the case of a powder compacting method are preferably such that the molding pressure is about 200 MPa or more and 1000 MPa or less (2 t/cm$^2$ or more and 10 t/cm$^2$ or less), which vary depending on the respective conditions such as the composition and the particle diameter of the titanium alloy powder to be used, the composition of the organic binder, and the blending amounts thereof.

The molding conditions in the case of the titanium alloy powder are preferably such that the material temperature is about 80° C. or higher and 210° C. or lower, and the injection pressure is about 50 MPa or more and 500 MPa or less (0.5 t/cm$^2$ or more and 5 t/cm$^2$ or less), which also vary depending on the respective conditions.

The molding conditions in the case of an extrusion molding method are preferably such that the material temperature is about 80° C. or higher and 210° C. or lower, and the extrusion pressure is about 50 MPa or more and 500 MPa or less (0.5 t/cm$^2$ or more and 5 t/cm$^2$ or less), which also vary depending on the respective conditions.

The thus obtained molded body is in a state where the organic binder is uniformly distributed in gaps between the particles of the titanium alloy powder.

The shape and size of the molded body to be produced are determined in anticipation of shrinkage of the molded body in the subsequent degreasing step and firing step.

Further, if desired, the molded body may be subjected to machining processing such as grinding, polishing, or cutting. The molded body has a relatively low hardness and relatively high plasticity, and therefore, the machining processing can be easily performed while preventing the shape of the molded body from collapsing. According to such machining processing, the titanium sintered body 1 having high dimensional accuracy can be more easily obtained in the end.

[3] Degreasing Step

Subsequently, the thus obtained molded body is subjected to a degreasing treatment (binder removal treatment), whereby a degreased body is obtained.

Specifically, the degreasing treatment is performed in such a manner that the organic binder is decomposed by heating the molded body, whereby at least part of the organic binder is removed from the molded body.

Examples of the degreasing treatment include a method of heating the molded body and a method of exposing the molded body to a gas capable of decomposing the binder.

In the case of using a method of heating the molded body, the conditions for heating the molded body are preferably such that the temperature is about 100° C. or higher and 750° C. or lower and the time is about 0.1 hours or more and 20 hours or less, and more preferably such that the temperature is about 150° C. or higher and 600° C. or lower and the time is about 0.5 hours or more and 15 hours or less, which slightly vary depending on the composition and the blending amount of the organic binder. According to this, the degreasing of the molded body can be necessarily and sufficiently performed without sintering the molded body. As a result, it is possible to prevent the organic binder component from remaining inside the degreased body in a large amount.

The atmosphere when the molded body is heated is not particularly limited, and an atmosphere of a reducing gas such as hydrogen, an atmosphere of an inert gas such as nitrogen or argon, an atmosphere of an oxidative gas such as air, a reduced pressure atmosphere obtained by depressurizing such an atmosphere, and the like are exemplified.

Examples of the gas capable of decomposing the binder include ozone gas.

By dividing such a degreasing step into a plurality of steps in which the degreasing conditions are different, and performing the plurality of steps, the organic binder in the molded body can be more rapidly decomposed and removed so that the organic binder does not remain in the molded body.

Further, if desired, the degreased body may be subjected to machining processing such as grinding, polishing, or cutting. The degreased body has a relatively low hardness and relatively high plasticity, and therefore, the machining processing can be easily performed while preventing the shape of the degreased body from collapsing. According to such machining processing, the titanium sintered body 1 having high dimensional accuracy can be more easily obtained in the end.

[4] Firing Step

Subsequently, the obtained degreased body is fired in a firing furnace, whereby a sintered body is obtained. That is, diffusion occurs at the interface between the particles of the titanium alloy powder, resulting in sintering. As a result, the titanium sintered body 1 is obtained.

The firing temperature varies depending on the composition, the particle diameter, and the like of the titanium alloy powder, but is, for example, about 900° C. or higher and 1400° C. or lower, and preferably about 1250° C. or higher and 1350° C. or lower.

The firing time is 0.2 hours or more and 20 hours or less, but is preferably about 1 hour or more and 6 hours or less.

In the firing step, the firing temperature or the below-mentioned firing atmosphere may be changed in the middle of the step.

The atmosphere when performing firing is not particularly limited, however, in consideration of prevention of significant oxidation of the metal powder, an atmosphere of a reducing gas such as hydrogen, an atmosphere of an inert gas such as argon, a reduced pressure atmosphere obtained by depressurizing such an atmosphere, or the like is preferably used.

In the case where the titanium sintered body 1 is produced from the titanium alloy powder, depending on the firing conditions or the like, both the α-phase 2 and the β-phase 3 are sometimes formed. In particular, in the case where the above-mentioned β-phase stabilizing element is contained in the titanium alloy powder, the β-phase 3 is more reliably formed.

On the other hand, by utilizing the respective production conditions, the average crystal grain diameter in the titanium sintered body 1 can be adjusted. For example, by increasing the firing temperature or prolonging the firing time, the crystal grain diameter tends to increase, and therefore, the average crystal grain diameter can be adjusted based on such a tendency. Further, when the firing temperature is increased, the proportion of the β-phase 3 is increased, and accompanying this, the Vickers hardness on the surface of the titanium sintered body 1 tends to increase. Therefore, the Vickers hardness of the titanium sintered body 1 to be produced can be adjusted based on such a tendency.

Further, in the case where the average crystal grain diameter is within the above range, as the proportion of the β-phase 3 is lower and the proportion of the α-phase 2 is higher, a tendency that the shape of the crystal structure approaches an isotropic shape is shown. Therefore, the average aspect ratio of the crystal structures on the surface of the titanium sintered body 1 can be adjusted based on such a tendency.

[5] HIP Step

The thus obtained titanium sintered body 1 may be further subjected to an HIP treatment (hot isostatic pressing treatment) or the like. By doing this, the density of the titanium sintered body 1 is further increased, and thus, an ornament having further excellent mechanical properties can be obtained.

As the conditions for the HIP treatment, for example, the temperature is 850° C. or higher and 1200° C. or lower, and the time is about 1 hour or more and 10 hours or less.

Further, the pressure to be applied is preferably 50 MPa or more, and more preferably 100 MPa or more and 500 MPa or less.

In addition, the obtained titanium sintered body 1 may be further subjected to an annealing treatment, a solution heat treatment, an aging treatment, a hot working treatment, a cold working treatment, or the like.

The obtained titanium sintered body 1 may be subjected to a polishing treatment as desired. The polishing treatment is not particularly limited, however, examples thereof include electrolytic polishing, buffing, dry polishing, chemical polishing, barrel polishing, and sand blasting.

Hereinabove, the titanium sintered body, the ornament, and the timepiece according to the invention have been described with reference to preferred embodiments, however, the invention is not limited thereto.

For example, the use of the titanium sintered body is not limited to the ornament, the timepiece, etc., and may be various structural components and the like. Examples of the structural components include components for transport machinery such as components for automobiles, components for bicycles, components for railroad cars, components for ships, components for airplanes, and components for space transport machinery (such as rockets), components for electronic devices such as components for personal computers and components for cellular phone terminals, components for electrical devices such as refrigerators, washing machines, and cooling and heating machines, components for machines such as machine tools and semiconductor production devices, components for plants such as atomic power plants, thermal power plants, hydroelectric power plants, oil refinery plants, and chemical complexes, and medical devices such as surgical instruments, artificial bones, joint prostheses, artificial teeth, artificial dental roots, and orthodontic components.

The titanium sintered body has high biocompatibility, and therefore is particularly useful as an artificial bone and a dental metallic component. Among these, the dental metallic component is not particularly limited as long as it is a metallic component which is temporarily or semi-permanently retained in the mouth, and examples thereof include metal frames such as an inlay, a crown, a bridge, a metal base, a denture, an implant, an abutment, a fixture, and a screw.

EXAMPLES

Next, specific examples of the invention will be described.

1. Production of Titanium Sintered Body

Example 1

<1> First, a Ti-6Al-4V alloy powder having an average particle diameter of 20 μm produced by a gas atomization method was prepared.

Subsequently, a mixture (organic binder) of polypropylene and a wax was prepared and weighed so that the mass ratio of the raw material powder to the organic binder was 9:1, whereby a composition for producing a titanium sintered body was obtained.

Subsequently, the obtained composition for producing a titanium sintered body was kneaded using a kneader, whereby a compound was obtained. Then, the compound was processed into pellets.

<2> Subsequently, molding was performed under the following molding conditions using the obtained pellets, whereby a molded body was produced.

Molding Conditions

Molding method: metal injection molding method

Material temperature: 160° C.

Injection pressure: 12 MPa (120 kgf/cm$^2$)

<3> Subsequently, the obtained molded body was subjected to a degreasing treatment under the following degreasing conditions, whereby a degreased body was obtained.

Degreasing Conditions

Degreasing temperature: 530° C.

Degreasing time: 5 hours

Degreasing atmosphere: nitrogen gas atmosphere

<4> Subsequently, the obtained degreased body was fired under the following firing conditions, whereby a sintered body was produced.

Firing Conditions

Firing temperature: 1300° C.

Firing time: 2 hours

Firing atmosphere: argon gas atmosphere

Pressure in atmosphere: atmospheric pressure (100 kPa)

<5> Subsequently, the surface of the obtained titanium sintered body was subjected to a buffing treatment.

Subsequently, the polished surface was observed with an electron microscope, and the types of the crystal phases constituting the crystal structure, the average crystal grain diameter, and the average aspect ratio of the crystals were obtained, respectively. The results are shown in Table 1.

<6> Subsequently, with respect to the polished surface of the obtained titanium sintered body, the Vickers hardness was measured in accordance with the method specified in JIS Z 2244:2009. The measurement result is shown in Table 1.

<7> Subsequently, with respect to the obtained titanium sintered body, the oxygen content and the carbon content were measured. The measurement results are shown in Table 1.

<8> Subsequently, with respect to the obtained titanium sintered body, the arithmetic average roughness Ra and the root mean square roughness Rq were measured. The measurement results are shown in Table 1.

<9> Subsequently, with respect to the titanium sintered body obtained in Example 1, a crystal structure analysis was performed by X-ray diffractometry under the following measurement conditions.

Measurement Conditions for Crystal Structure Analysis by X-ray Diffractometry

X-ray source: Cu-Kα radiation

Tube voltage: 30 kV

Tube current: 20 mA

It was found that the X-ray diffraction pattern obtained for this titanium sintered body includes a diffraction intensity peak A attributed to the hexagonal crystal structure of titanium and a diffraction intensity peak B attributed to the tetragonal crystal structure of vanadium oxide represented by $V_4O_9$. Therefore, the multiple of the integrated intensity of the peak A with respect to the integrated intensity of the peak B was calculated. The calculation result is shown in Table 1.

Examples 2 to 6

Titanium sintered bodies were obtained in the same manner as in Example 1 except that the production conditions were changed so that the evaluation results of the average crystal grain diameter, the average aspect ratio of the crystals, the Vickers hardness, the oxygen content, the carbon content, the surface roughness, and the X-ray diffraction became the values shown in Table 1, respectively.

Comparative Examples 1 to 3

Titanium sintered bodies were obtained in the same manner as in Example 1 except that the production conditions were changed so that the evaluation results of the average crystal grain diameter, the average aspect ratio of the crystals, the Vickers hardness, the oxygen content, the carbon content, the surface roughness, and the X-ray diffraction became the values shown in Table 1, respectively.

Reference Example 1

First, a Ti-6Al-4V alloy ingot material was prepared.

Subsequently, the surface of the prepared ingot material was subjected to a buffing treatment.

Subsequently, the polished surface was observed with an electron microscope, and the types of the crystal phases constituting the crystal structure, the average crystal grain diameter, and the average aspect ratio of crystals were obtained, respectively. The results are shown in Table 1.

Further, the evaluation results of the Vickers hardness, the oxygen content, the carbon content, the surface roughness, and the X-ray diffraction were obtained in the same manner as described above, respectively. The results are shown in Table 1.

Example 7

A titanium sintered body was obtained in the same manner as in Example 1 except that a Ti-3Al-2.5V alloy powder having an average particle diameter of 20 μm was used in place of the Ti-6Al-4V alloy powder.

Then, the surface of the obtained titanium sintered body was subjected to a buffing treatment.

Subsequently, the polished surface was observed with an electron microscope, and the types of the crystal phases constituting the crystal structure, the average crystal grain diameter, and the average aspect ratio of the crystals were obtained, respectively. The results are shown in Table 2.

Further, the evaluation results of the Vickers hardness, the oxygen content, the carbon content, the surface roughness, and the X-ray diffraction were obtained in the same manner as described above, respectively. The results are shown in Table 2.

Examples 8 to 12

Titanium sintered bodies were obtained in the same manner as in Example 7 except that the production conditions were changed so that the evaluation results of the average crystal grain diameter, the average aspect ratio of the crystals, the Vickers hardness, the oxygen content, the carbon content, the surface roughness, and the X-ray diffraction became the values shown in Table 2, respectively.

Comparative Examples 4 to 6

Titanium sintered bodies were obtained in the same manner as in Example 7 except that the production conditions were changed so that the evaluation results of the average crystal grain diameter, the average aspect ratio of the crystals, the Vickers hardness, the oxygen content, the carbon content, the surface roughness, and the X-ray diffraction became the values shown in Table 2, respectively.

Reference Example 2

First, a Ti-3Al-2.5V alloy ingot material was prepared.

Subsequently, the surface of the prepared ingot material was subjected to a buffing treatment.

Subsequently, the polished surface was observed with an electron microscope, and the types of the crystal phases constituting the crystal structure, the average crystal grain diameter, and the average aspect ratio of the crystals were obtained, respectively. The results are shown in Table 2.

Further, the evaluation results of the Vickers hardness, the oxygen content, the carbon content, the surface roughness, and the X-ray diffraction were obtained in the same manner as described above, respectively. The results are shown in Table 2.

Example 13

A titanium sintered body was obtained in the same manner as in Example 1 except that a Ti-6Al-7Nb alloy powder having an average particle diameter of 20 μm was used in place of the Ti-6Al-4V alloy powder.

Then, the surface of the obtained titanium sintered body was subjected to a buffing treatment.

Subsequently, the polished surface was observed with an electron microscope, and the types of the crystal phases constituting the crystal structure, the average crystal grain diameter, and the average aspect ratio of the crystals were obtained, respectively. The results are shown in Table 3.

Further, the evaluation results of the Vickers hardness, the oxygen content, the carbon content, the surface roughness, and the X-ray diffraction were obtained in the same manner as described above, respectively. The results are shown in Table 3.

Examples 14 to 18

Titanium sintered bodies were obtained in the same manner as in Example 13 except that the production conditions were changed so that the evaluation results of the average crystal grain diameter, the average aspect ratio of the crystals, the Vickers hardness, the oxygen content, the carbon content, the surface roughness, and the X-ray diffraction became the values shown in Table 3, respectively.

Comparative Examples 7 to 9

Titanium sintered bodies were obtained in the same manner as in Example 13 except that the production conditions were changed so that the evaluation results of the average crystal grain diameter, the average aspect ratio of the crystals, the Vickers hardness, the oxygen content, the carbon content, the surface roughness, and the X-ray diffraction became the values shown in Table 3, respectively.

Reference Example 3

First, a Ti-6Al-7Nb alloy ingot material was prepared.

Subsequently, the surface of the prepared ingot material was subjected to a buffing treatment.

Subsequently, the polished surface was observed with an electron microscope, and the types of the crystal phases constituting the crystal structure, the average crystal grain diameter, and the average aspect ratio of the crystals were obtained, respectively. The results are shown in Table 3.

Further, the evaluation results of the Vickers hardness, the oxygen content, the carbon content, the surface roughness, and the X-ray diffraction were obtained in the same manner as described above, respectively. The results are shown in Table 3.

2. Evaluation of Titanium Sintered Body 2.1. Wear Resistance

First, with respect to each of the titanium sintered bodies of the respective Examples and Comparative Examples, and titanium ingot materials of the respective Reference Examples, the wear resistance of the surface thereof was evaluated. Specifically, first, the surface of each of the titanium sintered bodies and the titanium ingot materials was subjected to a buffing treatment. Subsequently, for the polished surface, a wear resistance test was performed in accordance with Testing method for wear resistance of fine ceramics by ball-on-disk method specified in JIS R 1613 (2010), and a wear amount of a disk-shaped test piece was measured. The measurement conditions were as follows.

Measurement Conditions for Specific Wear Amount

- Material of spherical test piece: high carbon chromium bearing steel (SUJ2)
- Size of spherical test piece: diameter: 6 mm
- Material of disk-shaped test piece: each of titanium sintered bodies of respective Examples and Comparative Examples and each of titanium ingot materials of respective Reference Examples
- Size of disk-shaped test piece: diameter: 35 mm, thickness: 5 mm
- Magnitude of load: 10 N
- Sliding rate: 0.1 m/s
- Sliding circle diameter: 30 mm
- Sliding distance: 50 m Then, the wear amount obtained for the titanium ingot material of Reference Example 1 was taken as 1, and the relative value of the wear amount obtained for each of the titanium sintered bodies of the respective Examples and Comparative Examples shown in Table 1 was calculated.

Similarly, the wear amount obtained for the titanium ingot material of Reference Example 2 was taken as 1, and the relative value of the wear amount obtained for each of the titanium sintered bodies of the respective Examples and Comparative Examples shown in Table 2 was calculated.

Further similarly, the wear amount obtained for the titanium ingot material of Reference Example 3 was taken as 1, and the relative value of the wear amount obtained for each of the titanium sintered bodies of the respective Examples and Comparative Examples shown in Table 3 was calculated.

Then, the calculated relative value was evaluated according to the following evaluation criteria. The evaluation results are shown in Tables 1 to 3.

Evaluation Criteria for Wear Amount

- A: The wear amount is very small (the relative value is less than 0.5).
- B: The wear amount is small (the relative value is 0.5 or more and less than 0.75).
- C: The wear amount is slightly small (the relative value is 0.75 or more and less than 1).
- D: The wear amount is slightly large (the relative value is 1 or more and less than 1.25).
- E: The wear amount is large (the relative value is 1.25 or more and less than 1.5).
- F: The wear amount is very large (the relative value is more than 1.5).

2.2. Tensile Strength

Subsequently, with respect to each of the titanium sintered bodies of the respective Examples and Comparative Examples and each of the titanium ingot materials of the respective Reference Examples, the tensile strength was measured. The measurement of the tensile strength was performed in accordance with the metal material tensile test method specified in JIS Z 2241 (2011).

Then, the tensile strength obtained for the titanium ingot material of Reference Example 1 was taken as 1, and the relative value of the tensile strength obtained for each of the titanium sintered bodies of the respective Examples and Comparative Examples shown in Table 1 was calculated.

Similarly, the tensile strength obtained for the titanium ingot material of Reference Example 2 was taken as 1, and the relative value of the tensile strength obtained for each of the titanium sintered bodies of the respective Examples and Comparative Examples shown in Table 2 was calculated.

Further similarly, the tensile strength obtained for the titanium ingot material of Reference Example 3 was taken as 1, and the relative value of the tensile strength obtained for each of the titanium sintered bodies of the respective Examples and Comparative Examples shown in Table 3 was calculated.

Then, the obtained relative value was evaluated according to the following evaluation criteria. The evaluation results are shown in Tables 1 to 3.

Evaluation Criteria for Tensile Strength

- A: The tensile strength is very large (the relative value is 1.09 or more).
- B: The tensile strength is large (the relative value is 1.06 or more and less than 1.09).
- C: The tensile strength is slightly large (the relative value is 1.3 or more and less than 1.06).

D: The tensile strength is slightly small (the relative value is 1 or more and less than 1.03).

E: The tensile strength is small (the relative value is 0.97 or more and less than 1).

F: The tensile strength is very small (the relative value is less than 0.97).

2.3. Nominal Strain at Break (Elongation at Break)

Subsequently, with respect to each of the titanium sintered bodies of the respective Examples and Comparative Examples and each of the titanium ingot materials of the respective Reference Examples, the elongation at break was measured. The measurement of the elongation at break was performed in accordance with the metal material tensile test method specified in JIS Z 2241 (2011).

Then, the obtained elongation at break was evaluated according to the following evaluation criteria. The evaluation results are shown in Tables 1 to 3.

Evaluation Criteria for Elongation at Break

A: The elongation at break is very large (0.15 or more).

B: The elongation at break is large (0.125 or more and less than 0.15).

C: The elongation at break is slightly large (0.10 or more and less than 0.125).

D: The elongation at break is slightly small (0.075 or more and less than 0.10).

E: The elongation at break is small (0.050 or more and less than 0.075).

F: The elongation at break is very small (less than 0.050).

2.4. Design Property 2.4.1. Initial Design Property

Subsequently, with respect to a test specimen composed of each of the titanium sintered bodies of the respective Examples and Comparative Examples and each of the titanium ingot materials of the respective Reference Examples, a sensory evaluation was performed by 10 assessors. This sensory evaluation was performed in accordance with the ranking method of the sensory evaluation analysis in JIS Z 9080:2004.

Specifically, first, each test specimen was distributed to each assessor, and the assessor was asked to observe the polished surface. Then, the assessor was asked to evaluate the design property based on the luster in light of the 9-level preference scale specified in JIS Z 9080:2004. In the 9-level preference scale, indicates "most pleasant", and "1" indicates "most unpleasant".

The evaluation results are shown in Tables 1 to 3.

2.4.2. Design Property after Rubbing Treatment

First, the polished surface of each test specimen was subjected to a shot blast treatment (rubbing treatment) using a nylon shot (an abrasive material for blasting made of nylon).

Subsequently, with respect to the treated surface, the same sensory evaluation as in 2.4.1. was performed again.

The evaluation results are shown in Tables 1 to 3.

TABLE 1

| | Structure of titanium sintered body | | | | | | | |
|---|---|---|---|---|---|---|---|---|
| | | | | Crystal | | | | |
| | Production method — | Composition — | Crystal structure — | Average grain diameter μm | Aspect ratio — | Oxygen content ppm | Carbon content ppm | Vickers hardness — |
| Example 1 | Sintered body | Ti—6Al—4V | α + β | 60 | 1.6 | 3700 | 620 | 392 |
| Example 2 | Sintered body | Ti—6Al—4V | α + β | 60 | 1.8 | 4300 | 650 | 406 |
| Example 3 | Sintered body | Ti—6Al—4V | α + β | 144 | 2.0 | 3300 | 750 | 524 |
| Example 4 | Sintered body | Ti—6Al—4V | α + β | 56 | 1.4 | 4700 | 500 | 419 |
| Example 5 | Sintered body | Ti—6Al—4V | α + β | 224 | 2.3 | 2900 | 870 | 556 |
| Example 6 | Sintered body | Ti—6Al—4V | α + β | 30 | 2.1 | 5200 | 3500 | 433 |
| Comparative Example 1 | Sintered body | Ti—6Al—4V | α + β | 12 | 1.3 | 5900 | 5090 | 860 |
| Comparative Example 2 | Sintered body | Ti—6Al—4V | α + β | 525 | 5.0 | 2500 | 4500 | 257 |
| Comparative Example 3 | Sintered body | Ti—6Al—4V | α + β | 189 | 6.8 | 2200 | 3200 | 516 |
| Reference Example 1 | Ingot material | Ti—6Al—4V | α + β | 6 | 3.4 | 400 | 150 | 3015 |

| | Structure of titanium sintered body | | | Evaluation results | | | | |
|---|---|---|---|---|---|---|---|---|
| | Surface roughness | | | | | | Design property | |
| | Arithmetic average roughness Ra μm | Root mean square roughness Rq μm | X-ray diffraction Peak A/ peak B times | Wear resistance — | Tensile strength — | Elongation at break — | Initial — | After rubbing treatment — |
| Example 1 | 4.5 | 7.2 | 8 | A | A | B | 7 | 7 |
| Example 2 | 4.3 | 6.9 | 7 | A | A | B | 7 | 7 |
| Example 3 | 3.6 | 5.8 | 10 | B | B | B | 8 | 8 |
| Example 4 | 4.1 | 6.6 | 6 | B | B | B | 7 | 7 |

TABLE 1-continued

| | | | | | | | | |
|---|---|---|---|---|---|---|---|---|
| Example 5 | 3.3 | 5.3 | 12 | B | B | B | 9 | 9 |
| Example 6 | 5.2 | 8.3 | 5 | B | C | B | 6 | 6 |
| Comparative Example 1 | 7.0 | 11.2 | 3 | D | D | C | 3 | 3 |
| Comparative Example 2 | 6.5 | 10.4 | 4 | D | E | C | 5 | 3 |
| Comparative Example 3 | 5.0 | 8.0 | 5 | D | E | C | 8 | 5 |
| Reference Example 1 | 9.2 | 14.7 | 2 | D | C | C | 2 | 2 |

TABLE 2

| | Structure of titanium sintered body | | | | | | | |
|---|---|---|---|---|---|---|---|---|
| | | | | Crystal | | | | |
| | Production method — | Composition — | Crystal structure — | Average grain diameter μm | Aspect ratio — | Oxygen content ppm | Carbon content ppm | Vickers hardness — |
| Example 7 | Sintered body | Ti—3Al—2.5V | α + β | 72 | 1.8 | 3800 | 630 | 383 |
| Example 8 | Sintered body | Ti—3Al—2.5V | α + β | 55 | 1.9 | 4300 | 680 | 392 |
| Example 9 | Sintered body | Ti—3Al—2.5V | α + β | 150 | 2.1 | 3200 | 710 | 515 |
| Example 10 | Sintered body | Ti—3Al—2.5V | α + β | 63 | 1.5 | 4800 | 480 | 410 |
| Example 11 | Sintered body | Ti—3Al—2.5V | α + β | 216 | 2.3 | 2500 | 880 | 547 |
| Example 12 | Sintered body | Ti—3Al—2.5V | α + β | 36 | 2.5 | 5400 | 3600 | 424 |
| Comparative Example 4 | Sintered body | Ti—3Al—2.5V | α + β | 12 | 1.5 | 6500 | 4980 | 851 |
| Comparative Example 5 | Sintered body | Ti—3Al—2.5V | α + β | 540 | 5.3 | 2500 | 4600 | 248 |
| Comparative Example 6 | Sintered body | Ti—3Al—2.5V | α + β | 196 | 7.4 | 1700 | 3300 | 507 |
| Reference Example 2 | Ingot material | Ti—3Al—2.5V | α + β | 5 | 3.5 | 500 | 120 | 3006 |

| | Structure of titanium sintered body | | | Evaluation results | | | | |
|---|---|---|---|---|---|---|---|---|
| | Surface roughness | | | | | | Design property | |
| | Arithmetic average roughness Ra μm | Root mean square roughness Rq μm | X-ray diffraction Peak A/peak B times | Wear resistance — | Tensile strength — | Elongation at break — | Initial — | After rubbing treatment — |
| Example 7 | 4.7 | 7.5 | 7 | A | A | B | 7 | 7 |
| Example 8 | 4.5 | 7.2 | 8 | A | A | B | 7 | 7 |
| Example 9 | 3.7 | 5.9 | 9 | A | B | B | 8 | 8 |
| Example 10 | 4.3 | 6.9 | 6 | B | B | B | 7 | 7 |
| Example 11 | 3.2 | 5.1 | 11 | B | B | B | 9 | 8 |
| Example 12 | 5.3 | 8.5 | 5 | B | C | B | 6 | 6 |
| Comparative Example 4 | 7.8 | 12.5 | 3 | D | D | C | 3 | 3 |
| Comparative Example 5 | 6.2 | 9.9 | 4 | D | E | C | 5 | 3 |
| Comparative Example 6 | 4.9 | 7.8 | 5 | D | E | C | 8 | 5 |
| Reference Example 2 | 10.3 | 16.5 | 2 | D | C | C | 2 | 2 |

TABLE 3

| | Production method — | Composition — | Crystal structure — | Average grain diameter μm | Aspect ratio — | Oxygen content ppm | Carbon content ppm | Vickers hardness — |
|---|---|---|---|---|---|---|---|---|
| | | Structure of titanium sintered body | | | | | | |
| | | | | Crystal | | | | |
| Example 13 | Sintered body | Ti—6Al—7Nb | α + β | 52 | 1.7 | 3400 | 680 | 401 |
| Example 14 | Sintered body | Ti—6Al—7Nb | α + β | 45 | 1.7 | 4600 | 700 | 410 |
| Example 15 | Sintered body | Ti—6Al—7Nb | α + β | 132 | 1.9 | 3200 | 850 | 524 |
| Example 16 | Sintered body | Ti—6Al—7Nb | α + β | 49 | 1.4 | 4900 | 450 | 428 |
| Example 17 | Sintered body | Ti—6Al—7Nb | α + β | 200 | 2.0 | 2600 | 900 | 556 |
| Example 18 | Sintered body | Ti—6Al—7Nb | α + β | 30 | 2.0 | 5500 | 3800 | 446 |
| Comparative Example 7 | Sintered body | Ti—6Al—7Nb | α + β | 12 | 1.4 | 6300 | 5410 | 869 |
| Comparative Example 8 | Sintered body | Ti—6Al—7Nb | α + β | 555 | 5.4 | 2900 | 4600 | 239 |
| Comparative Example 9 | Sintered body | Ti—6Al—7Nb | α + β | 203 | 7.0 | 2100 | 3300 | 498 |
| Reference Example 3 | Ingot material | Ti—6Al—7Nb | α + β | 6 | 3.9 | 600 | 160 | 2997 |

| | Structure of titanium sintered body | | | Evaluation results | | | | |
|---|---|---|---|---|---|---|---|---|
| | Surface roughness | | | | | | Design property | |
| | Arithmetic average roughness Ra μm | Root mean square roughness Rq μm | X-ray diffraction Peak A/peak B times | Wear resistance — | Tensile strength — | Elongation at break — | Initial — | After rubbing treatment — |
| Example 13 | 4.3 | 6.9 | — | A | A | B | 7 | 7 |
| Example 14 | 4.1 | 6.6 | — | A | A | B | 7 | 7 |
| Example 15 | 3.6 | 5.8 | — | B | B | B | 8 | 8 |
| Example 16 | 4.5 | 7.2 | — | A | B | B | 7 | 7 |
| Example 17 | 3.1 | 5.0 | — | B | B | B | 9 | 9 |
| Example 18 | 5.7 | 9.1 | — | B | C | B | 6 | 6 |
| Comparative Example 7 | 8.2 | 13.1 | — | D | D | C | 3 | 3 |
| Comparative Example 8 | 6.4 | 10.2 | — | D | E | C | 5 | 3 |
| Comparative Example 9 | 5.1 | 8.2 | — | D | E | C | 8 | 5 |
| Reference Example 3 | 10.5 | 16.8 | — | D | B | C | 2 | 2 |

As apparent from Tables 1 to 3, it was confirmed that the polished surface of each of the titanium sintered bodies of the respective Examples has a high design property.

The entire disclosure of Japanese Patent Application No. 2017-167825 filed Aug. 31, 2017 is expressly incorporated herein by reference.

What is claimed is:

1. A titanium sintered body, comprising:

particles of a titanium based powder sintered to one another, the titanium based powder including gallium as an α-phase stabilizing element;

an average crystal grain diameter on a surface of the body of more than 30 μm, and 500 μm or less;

an average aspect ratio of crystal structures of the titanium based powder is 2.1 or more and 3 or less; and a Vickers hardness on the surface of 300 or more and 800 or less, wherein an oxygen content on the surface is 3200 ppm by mass or more and 5500 ppm by mass or less; and wherein a carbon content on the surface is 200 ppm by mass or more and 870 ppm by mass or less.

2. The titanium sintered body according to claim 1, wherein the sintered body comprises:

the particles of titanium as a main component;

the α-phase stabilizing element; and a β-phase stabilizing element.

3. An ornament comprising the titanium sintered body according to claim 1.

4. A timepiece comprising the titanium sintered body according to claim 1.

* * * * *